US006186040B1

(12) United States Patent
Weise et al.

(10) Patent No.: US 6,186,040 B1
(45) Date of Patent: Feb. 13, 2001

(54) PLASMA BURNING DEVICE FOR ELECTROTHERMAL AND ELECTROTHERMAL/CHEMICAL GUN SYSTEMS

(75) Inventors: Thomas Weise; Hans Karl Haak, both of Unterlüss; Holger Wisken, Braunschweig, all of (DE)

(73) Assignee: TZN Forschungs- und Entwicklungszentrum, Unterlüss (DE)

( * ) Notice: Under 35 U.S.C. 154(b), the term of this patent shall be extended for 0 days.

(21) Appl. No.: 09/215,144

(22) Filed: Dec. 18, 1998

(30) Foreign Application Priority Data

Dec. 23, 1997 (DE) ..... 197 57 443

(51) Int. Cl.[7] ..... F41F 1/00
(52) U.S. Cl. ..... 89/8; 102/472; 42/84
(58) Field of Search ..... 102/472; 89/8; 42/84

(56) References Cited

U.S. PATENT DOCUMENTS

| | | | | |
|---|---|---|---|---|
| 3,777,387 | * | 12/1973 | Ritchey | 42/84 |
| 4,640,180 | * | 2/1987 | Rose | 89/8 |
| 4,895,062 | * | 1/1990 | Chryssomallis et al. | 89/8 |
| 4,913,209 | | 4/1990 | Tidman et al. | 89/8 |
| 5,115,743 | * | 5/1992 | Loffler | 102/472 |
| 5,287,791 | | 2/1994 | Chaboki et al. | 89/8 |
| 5,355,764 | | 10/1994 | Marinos et al. | 89/8 |
| 5,503,081 | | 4/1996 | Lindblom et al. | 102/472 |
| 5,612,506 | * | 3/1997 | Goldstein | 102/472 |

FOREIGN PATENT DOCUMENTS

| | | | |
|---|---|---|---|
| 44 40 829 | | 5/1995 | (DE) . |
| 196 17 895 | | 2/1998 | (DE) . |
| 0 714 011 | | 5/1996 | (EP) . |
| 2275296 | * | 11/1990 | (JP) ..... 42/84 |

* cited by examiner

*Primary Examiner*—Stephen M. Johnson
(74) *Attorney, Agent, or Firm*—Venable; Gabor J. Kelemen

(57) ABSTRACT

A plasma burning device for an electrothermal/chemical gun system includes a case hating a bottom and an interior; plasma material accommodated in the interior; and a high-voltage electrode passing through the case bottom into the case interior. The high-voltage electrode is adapted to cooperate with a gun tube acting as a counter electrode for generating an arc to combust the plasma material. The high-voltage electrode includes a conductor bar adapted to be coupled to a high-voltage source; an insulation surrounding the conductor bar; a conductor sleeve electrically connected to an end of the conductor bar and extending towards the case bottom along a length portion of the conductor bar. The conductor sleeve surrounds the insulation and the conductor bar and has a non-insulated outer surface. Further, an insulating cap is provided which covers the end of the conductor bar.

14 Claims, 2 Drawing Sheets

PLASMA BURNING DEVICE FOR ELECTROTHERMAL AND ELECTROTHERMAL/CHEMICAL GUN SYSTEMS

CROSS REFERENCE TO RELATED APPLICATION

This application claims the priority of German Application No. 197 57 443,2 filed Dec. 23, 1997, which is incorporated herein by reference.

BACKGROUND OF THE INVENTION

This invention relates to a plasma burning device for electrothermal and electrothermal/chemical gun systems. The device has a high-voltage electrode which passes perpendicularly through a bottom zone of a container (case) accommodating the plasma material. The high-voltage electrode and the gun tube which functions as a counter electrode, are connected to a high-voltage source. The high-voltage electrode has an energy supply bar (current conductor bar) provided with an insulation.

U.S Pat. No. 5,287,791 discloses a precision generator for an electrothermal/chemical gun system, having an anode and a cathode for igniting the plasma. A thin wire disposed in the plasma channel electrically connects the anode and the cathode with one another. Upon applying a high voltage, the wire is combusted, whereby an arc is generated which ignites a propellant charge for launching a projectile.

U.S. Pat. No 5,355,764 likewise discloses a plasma generator for an electrothermal/chemical gun. The generator disclosed therein has an anode and a cathode as well as a thin metal wire therebetween within a plasma channel for igniting the plasma.

It is a disadvantage of both above-outlined conventional generators that long insulating paths are necessary to prevent an arc discharge from the high-voltage side (anode) to the grounded gun tube.

An annular plasma injector for an electrothermal/chemical driving system is described in U.S. Pat. No. 5,503,081. In one of the embodiments, a grounded cathode is electrically connected by an igniting wire externally of the plasma chamber with a high-voltage side. The igniting wire has the function of generating an arc. The element serving as the igniting wire is disposed in the fuel chambers, and the ground side is grounded via the gun tube. The element serving as the igniting wire is separated from the plasma by an insulating sleeve. If the intensity of current passing through the igniting wire is sufficiently high, the element is evaporated and supplies for the plasma the fuel mass contained in the element.

German Offenlegungsschrift No. 196 17 895 discloses a plasma injection device for electrothermal guns, having a multipart propellant case through which only one electrode passes; the second electrode is constituted by the grounded gun tube.

Because of the expansion of an arc between the inner electrode and the gun tube and the accompanying phenomenon, according to which the generated gas streams and arc root-points are driven into the gun tube, significant corrosion appears in the conical zone of the breech zone and occasionally also in the muzzle zone of the gun tube.

SUMMARY OF THE INVENTION

It is an object of the invention to provide an improved plasma burning device of the above-outlined type in which corrosion phenomena in the conical zone of a gun tube breech are prevented or at least minimized.

This object and others to become apparent as the specification progresses, are accomplished by the invention, according to which, briefly stated, the plasma burning device for an electrothermal/chemical gun system includes a case having a bottom and an interior; a plasma material accommodated in the interior; and a high-voltage electrode passing through the case bottom into the case interior. The high-voltage electrode is adapted to cooperate with a gun tube acting as a counter electrode for generating an arc to combust the plasma material. The high-voltage electrode includes a conductor bar adapted to be coupled to a high-voltage source; an insulation surrounding the conductor bar; a conductor sleeve electrically connected to an end of the conductor bar and extending towards the case bottom along a length portion of the conductor bar. The conductor sleeve surrounds the insulation and the conductor bar and has a non-insulated outer surface. Further, an insulating cap is provided which covers the end of the conductor bar.

According to the basic principle of the invention, a magnetic field which builds up in the gun tube is utilized in such a manner that the arc needed for a proper functioning of the plasma burner remains in the rearward zone of the gun breech. For this purpose the high-voltage electrode is so configured that the arc which is generated between the high-voltage electrode and the gun tube acting as the second electrode, is driven in the rearward direction of the gun tube by the magnetic field which builds up in a non-insulated region of the high-voltage electrode. During this occurrence the arc acts on the end face of the propellant which may be flat powder grains or compressed powder disks, causing combustion or vaporization in a direction opposite to the propellant gas flow.

According to the invention the high-voltage electrode has an inner conductor bar which delivers electric energy and which is surrounded by an insulation. The conductor bar is adjoined at its end by a non-insulated conductor sleeve which surrounds the insulation. Thus, the high-voltage electrode has along its terminal length portion a larger circumference than along its remaining length portion The end face of the high-voltage electrode which is oriented towards the muzzle of the weapon tube (that is, oriented away from the case bottom) is capped with an additional insulation.

According to an advantageous feature of the invention, the outer surface of the conductor sleeve is slotted. As a result, the arc rotates about the high-voltage electrode and thus ensures a homogenous combustion or evaporation of the propellant. If, in addition, the non-insulated conductor sleeve conically tapers from the free end of the high-voltage electrode in the direction of the case bottom, the arc may expand in a loop-like manner about the high-voltage electrode, whereby the arc moves more rapidly Such a phenomenon is also of advantage for the ignition, because at the beginning of the plasma ignition the arc is driven in the desired direction. By virtue of the configuration of the high-voltage electrode according to the invention, propellant powder which in prior art plasma burning devices is, as a rule, constituted by cylindrical parts, may be disk-shaped grains or plates, whereby a higher packing density and thus a higher energy conversion is achievable. The electrode configuration according to the invention ensures that the arc effects combustion on the disk surface of the powder propellant uniformly and efficiently. As a result, a higher acceleration of the projectile out of the gun tube is achieved If a metal cartridge is used, the latter may function as the second electrode, in which case it is electrically connected with the gun tube When a propellant case made of plastic, such as Durostone or PMNA, is used, the electrode configuration according to the invention drives the arc to the plasma and only thereafter reaches the inner breech wall functioning as the counter electrode.

Damages caused by erosions and ablations are minimized in the conical region of the gun tube breech by the particular configuration of the high-voltage electrode according to the invention.

DESCRIPTION OF THE PREFERRED EMBODIMENTS

Figure 1:
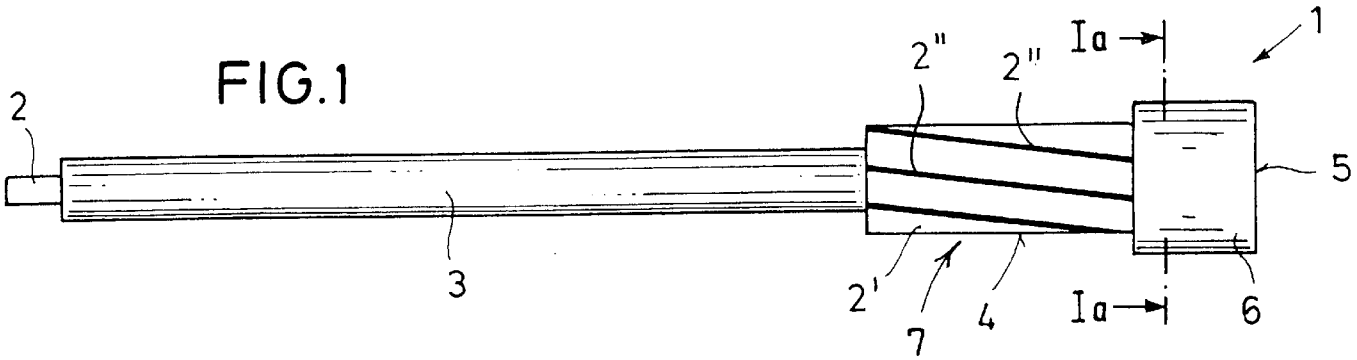
FIG. 1 is a side elevational view of a preferred embodiment of a high-voltage electrode.
Figure 1A:
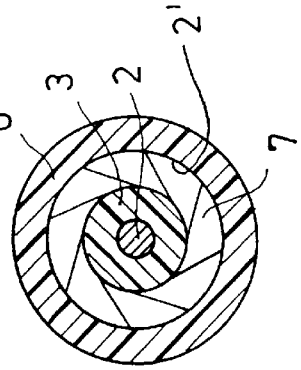
FIG. 1*a* is a sectional view taken along line Ia—Ia of FIG. 1.

FIGS. 1 and 1*a* show the basic structure of a high-voltage electrode 1 configured according to the invention and used as a component of a plasma burning device in an electrothermal or electrothermal-chemical gun.

The high-voltage electrode 1 has a metal energy-supplying (current conductor) bar 2 surrounded by an insulation 3. Also referring to FIGS. 2 and 3, at the end of the insulation 3 the bar 2 continues as a rearwardly extending conductor sleeve 7 which has an exposed (that is, non-insulated) outer surface 2' and which surrounds a terminal length portion of the insulation 3 and the conductor bar 2. Thus, the high-voltage electrode 1 has an enlarged circumference in the region 4. The electrode end, that is, the region where the bar 2 joins the sleeve 7, forms a head 5 covered by an insulating cap 6 for preventing an undesired arc discharge towards the gun tube 11.

Figure 2:
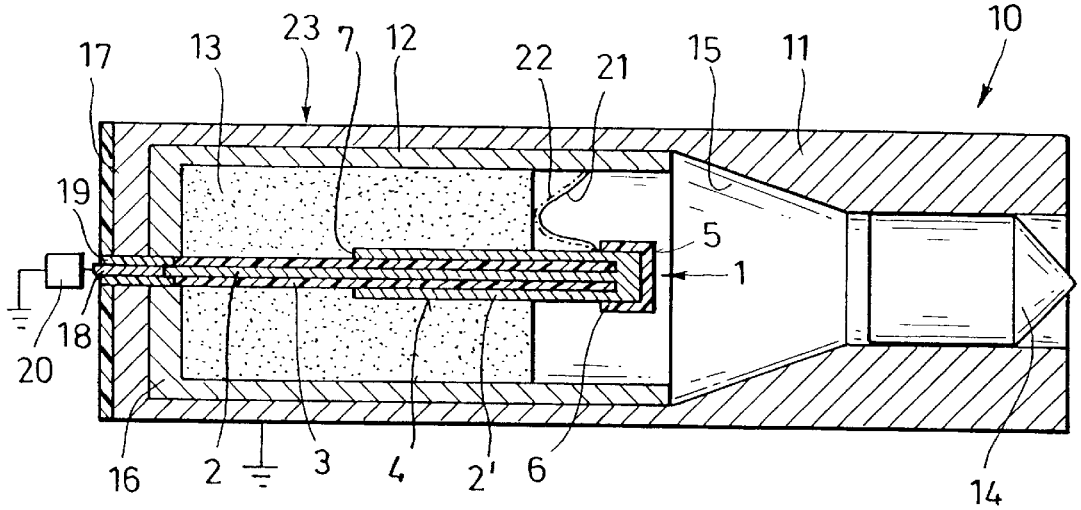
FIG. 2 is an axial sectional view of a breech of a gun tube accommodating a plasma burning device having a metal case and incorporating the high-voltage electrode according to FIGS. 1 and 1*a*.
Figure 2A:
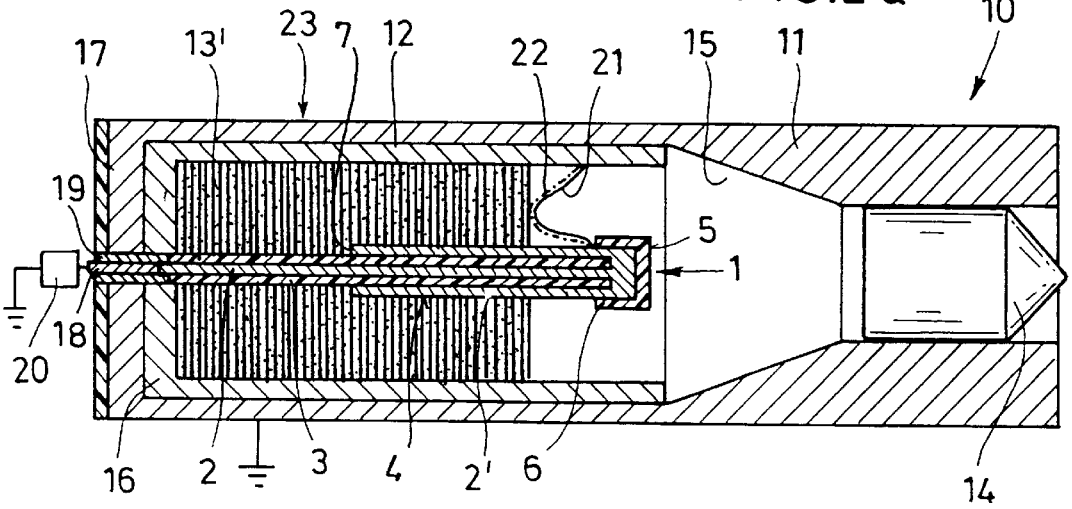
FIG. 2*a* is a variant of the FIG. 2 construction.

FIG. 2 illustrates an electrothermal or electrothermal/chemical gun system 10 which incorporates the earlier-described high-voltage electrode 1. The gun tube 11 of the gun system 10 accommodates a metal case 12 accommodating a plasma material 13 for generating propellant gases in the breech 23 of the gun tube. The plasma material 13 may be a powder or a liquid propellant such as methanol, water or metal hydride. Or, as shown in FIG. 2*a*, the plasma material may be formed of disk-shaped propellant powder bodies designated at 13'. A projectile 14 is secured to the end of the case 12 with the intermediary of a container 15. This arrangement allows for a replaceability of the metal case 12. It is feasible, however, to attach the projectile 14 directly to the case 12.

The high-voltage electrode 1 passes perpendicularly through the bottom region 16 of the metal case 12 such that the plasma material 13 surrounds the high-voltage electrode 1. The bottom region 16 is pressed against the breech base 17 of the gun 10 whereby the high-voltage electrode 1 assumes an electrically contacting relationship with a central electrode 18 positioned in the breech base 17. An insulation 19 insulates the central electrode 18 from the gun 10. To the central electrode 18 a high-voltage source 20 is connected which is grounded, together with the gun tube 11.

The high-voltage electrode 1 is connected by a wire 21 with the grounded gun tube 11 through the metal case 12 acting as a counter electrode. The wire 21 is attached to the exposed outer surface 2' of the metal conductor sleeve 7, preferably at a location from which the insulating cap 6 extends. When the weapon is fired, the wire 21 defines the path of an arc 22 in the plasma material 13.

Upon applying a high voltage to the central electrode 18 from the high-voltage source 20, current flows through the high-voltage electrode 1 and the wire 21 to the metal case 12. By virtue of the configuration of the high-voltage electrode 1, in the region of the conductor sleeve 7 and the insulating cap 6 a magnetic field is built up which has an electromagnetic force directed towards the bottom region 16 of the cartridge case 12 and thus opposite the direction of current flow in the bar 2. The arc 22 generated by the evaporation of the wire 21 is thus driven by the force of the magnetic field in the direction of the bottom region 16. During such a travel, the arc 22 impinges directly on the plasma material 13 whereby an expansion and combustion of the plasma material 13 occurs in a known manner, resulting in an acceleration and launching of the projectile 14.

The exposed surface 2' extends preferably along a significant length portion of the insulated conductor bar 2, whereby a short arc 22 is generated which moves in the direction of the case bottom 16. By providing a short arc 22, the voltage of the high-voltage source 20 may be maintained at a low value for obtaining the necessary arc voltage.

Figure 3:
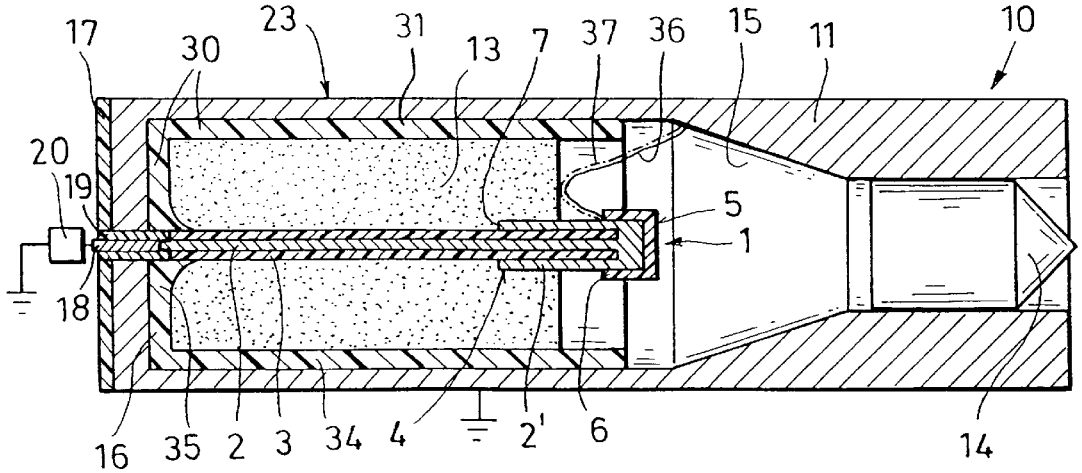
FIG. 3 is an axial sectional view of a breech of a gun tube accommodating a plasma burning device having a plastic s case and incorporating the high-voltage electrode according to FIGS. 1 and 1*a*.

In FIG. 3 the plasma burning device 30 has a case 31, whose sleeve portion 34 and bottom 35 are made of an electrically non-conducting material. As an alternative, the bottom 35 may be an electrically conducting (metal) component. In this embodiment too, the high-voltage electrode 1 projects perpendicularly through the bottom 35 into the case 31. A wire or several wires 36 electrically connect the high-voltage electrode 1 with the gun tube 11. An arc 37 is generated which extends obliquely to the plasma material 13 and travels therefrom towards the gun tube 11. As described for the arc 22 in conjunction with the FIG. 2 embodiment, the arc 37 is driven by the magnetic field force in the direction of the bottom region 35 and thus the plasma material 13 is combusted by the arc 37 in the propellant case 31.

Reverting to FIG. 1, as a further advantageous feature of the invention, slots 2" are provided in the outer surface 2' of the conductor sleeve 7. The slots 2" which preferably have a slightly curved (helical) course, extend from the head 5 to the axial end of the outer surface 2'. The slots 2" cause the arc 22 (FIG. 2) or 37 (FIG. 3) to rotate about the high-voltage electrode 1, as a result of which a continued combustion of the plasma material 13 is ensured since the arc 22, 37 has a more homogeneous burning effect on the plasma material 13.

Due to the magnetic forces in the gun tube 11, the arc 22, 37 remains in the region of the tube breech 23 and, in addition, the slots 2" in the surface 2' cause a rotation of the arc 22, 37 to thus provide a more homogeneous effect on the plasma material 13. Both measures serve to intensify the interaction between the arc 22, 37 and the plasma material 13. Since the arc 22, 37 acts on the end face, that is, on the immediate upper surface of the plasma material 13, there results a combustion or, as the case may be, a vaporization of the plasma material 13 progressing in a direction opposite to the flow of the propellant gases generated. The arcs, contrary to prior art arrangements, are prevented by the invention from being driven into the gun tube 11.

Figure 4:
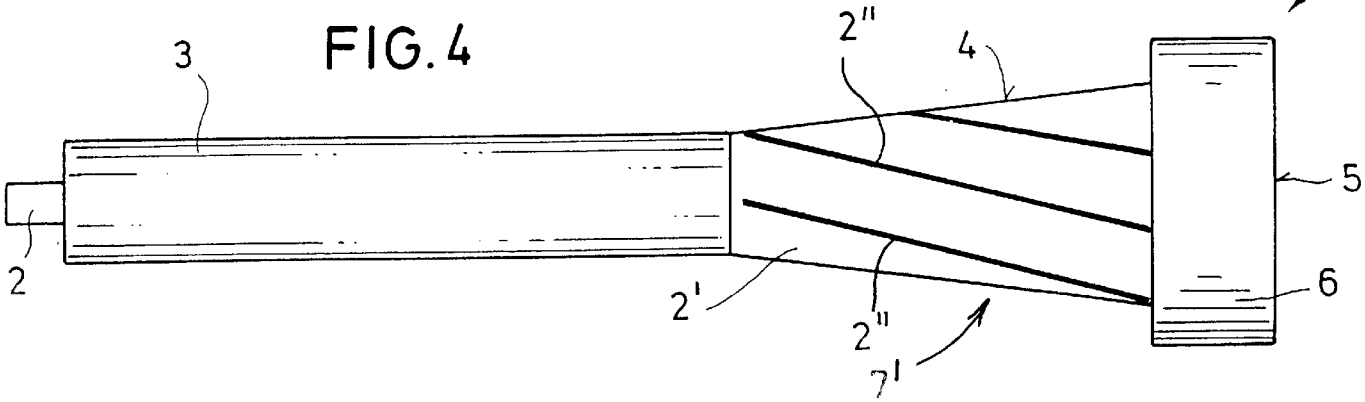
FIG. 4 is a side elevational view of a high-voltage electrode according to another preferred embodiment of the invention.

FIG. 4 shows another advantageous embodiment in which the conductor sleeve 7' is conically tapering in the direction away from the electrode head 5 in the direction of the case bottom 16 (FIG. 2) or 35 (FIG. 3). By virtue of such a conical shape, the rotating arc 22, 37 extends in a loop-shaped manner about the high-voltage electrode 1 so that as early as the beginning of the ignition of the plasma material 13, the arc 22, 37 is driven into the desired direction, that is, in the direction of the bottom zone 16, 35 for activating the plasma material 13.

When cylindrical powder bodies are used as a propellant, a significant percentage of dead volume will be present in the case interior. The configuration of the high-voltage electrode 1 according to the invention makes possible the use of disk-shaped powder, such as flat grains or compressed powder plates to achieve a higher efficiency during combustion of the plasma material 13. By utilizing disk-shaped powder as the plasma material 13 and a rotating, preferably loop-shaped arc 22, 23 about the high-voltage electrode 1, the surface of the disk-shaped powder grains or compressed powder plates is combusted in an optimal manner. Holes in the disk-shaped powder plates may be dispensed with because the force of the driven arc 22, 37 is sufficient to combust the surface of the propellant plates without any additional auxiliary measures. In addition to an optimal space utilization of the case 12, 31, a handling of the disk-shaped powder bodies is simplified.

The structural configuration of the high-voltage electrode 1 according to the invention may be obtained as follows:

To the end face of a conventional current conducting bar 2 which, up to such an end face, is wrapped in a fiber glass reinforced plastic insulation 3, a sleeve-shaped further current conductor 7 is attached such that it surrounds a terminal length portion of the bar 2 and the insulation 3. The inner surface of the conductor sleeve 7 carries no insulation, while its outer face 2" is surrounded by layers of fiber glass reinforced plastic. A frictional connection between the current conducting bar 2 and the conductor sleeve 7 may be effected, for example, by shrinking the conductor sleeve 7 onto the end of the conductor bar 2. The excess fiber glass reinforced plastic layers are thereafter unwound from the outer surface of the conductor sleeve 7 so that the conductor face 2' is exposed, while a part of the insulation, to constitute the insulating cap 6, is left in place.

It will be understood that the above description of the present invention is susceptible to various modifications, changes and adaptations, and the same are intended to be comprehended within the meaning and range of equivalents of the appended claims.

What is claimed is:

1. A plasma burning device for one of an electrothermal and electrothermal-chemical gun system, comprising (a) a case having a bottom and an interior;

(b) a plasma material accommodated in said interior; and (c) an electrode passing through said bottom into said interior of said case; said electrode being adapted to cooperate with a counter electrode for generating an arc to combust said plasma material; said electrode including (1) a conductor bar adapted to be coupled to a voltage source; said conductor bar having an end in a region of said interior;

(2) an insulation surrounding said conductor bar;

(3) a conductor sleeve electrically connected to said end of said conductor bar and extending towards said bottom of said case along a length portion of said conductor bar; said conductor sleeve surrounding said insulation and said conductor bar and having a non-insulated outer surface; and (4) an insulating cap covering said end.

2. The plasma burning device as defined in claim 1, wherein said conductor sleeve is slotted on said outer surface.

3. The plasma burning device as defined in claim 1, wherein said conductor sleeve has helically extending slots on said outer surface.

4. The plasma burning device as defined in claim 1, wherein said outer surface is conical.

5. The plasma burning device as defined in claim 1, wherein said outer surface conically tapers from said end of said conductor bar towards said bottom of said case.

6. The plasma burning device as defined in claim 1, wherein said plasma material is a powder.

7. The plasma burning device as defined in claim 1, wherein said plasma material is liquid propellant.

8. The plasma burning device as defined in claim 1, wherein said case is metal.

9. The plasma burning device as defined in claim 1, wherein said case has a sleeve portion of non-conducting material.

10. The plasma burning device as defined in claim 1, wherein said plasma material consists of disk-shaped propellant powder bodies.

11. The plasma burning device as defined in claim 1, further comprising a wire having a first end connected to said outer surface and a second end adapted to be connected to the counter electrode.

12. The plasma burning device as defined in claim 1, in combination with a gun tube; said gun tube constituting the counter electrode.

13. A plasma burning device for one of an electrothermal and electrothermal-chemical gun system, comprising (a) a case having a bottom and an interior;

(b) a plasma material accommodated in said interior;

(c) an electrode passing through said bottom into said interior of said case; said electrode being adapted to cooperate with a counter electrode for generating an arc to combust said plasma material; and (d) means included in said electrode for generating an electromagnetic force in a region where said arc is initiated for driving said arc in a direction towards said bottom of said case.

14. The plasma burning device as defined in claim 13, in combination with a gun tube; said gun tube constituting the counter electrode.

* * * * *